US009318788B2

(12) United States Patent
Spokoinyi

(10) Patent No.: US 9,318,788 B2
(45) Date of Patent: Apr. 19, 2016

(54) DIRECTIONAL COUPLER

(71) Applicant: Telefonaktiebolaget L M Ericsson (Publ), Stockholm (SE)

(72) Inventor: Igor Spokoinyi, Ottawa (CA)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 302 days.

(21) Appl. No.: 13/910,384

(22) Filed: Jun. 5, 2013

(65) Prior Publication Data

US 2014/0361953 A1 Dec. 11, 2014

(51) Int. Cl.

| | |
|---|---|
| ***H01P 5/18*** | (2006.01) |
| ***H01P 11/00*** | (2006.01) |
| *H01P 3/08* | (2006.01) |

(52) U.S. Cl.

CPC ..... *H01P 5/184* (2013.01); *H01P 5/185* (2013.01); *H01P 11/00* (2013.01); *Y10T 29/49016* (2015.01)

(58) Field of Classification Search

CPC ..... H01P 5/18; H01P 5/185; H01P 3/08
USPC ..... 333/109, 116
See application file for complete search history.

(56) References Cited

U.S. PATENT DOCUMENTS

| | | | | |
|---|---|---|---|---|
| 4,677,399 | A * | 6/1987 | Le Dain et al. | 333/116 |
| 5,159,298 | A | 10/1992 | Dydyk | |
| 5,424,694 | A | 6/1995 | Maloratsky et al. | |
| 6,392,503 | B1 | 5/2002 | Thornton | |
| 6,549,089 | B2 | 4/2003 | Ashoka | |
| 6,731,244 | B2 | 5/2004 | Killen et al. | |
| 7,248,129 | B2 | 7/2007 | Hubert | |
| 7,414,493 | B1 | 8/2008 | Hussain et al. | |
| 7,605,676 | B2 | 10/2009 | Dabrowski et al. | |
| 7,671,699 | B2 * | 3/2010 | Wren | 333/109 |
| 7,714,679 | B2 | 5/2010 | Jiang | |
| 7,880,560 | B2 | 2/2011 | He et al. | |
| 2009/0045888 | A1 | 2/2009 | Wren | |
| 2012/0119846 | A1 * | 5/2012 | Haruna | 333/116 |

FOREIGN PATENT DOCUMENTS

EP 2 360 776 A1 8/2011

OTHER PUBLICATIONS

M. Chudzik et al.—Design of EBG Microstrip Directional Coupler with High Directivity and Coupling Public University of Navarre, Electrical and Electronic Engineering Department, Pamplona, Spain 31006, TEC2011-28664-C02-01 (2011) consisting of 4-pages.

(Continued)

*Primary Examiner* — Dean Takaoka
(74) *Attorney, Agent, or Firm* — Christopher & Weisberg, P.A.

(57) ABSTRACT

Microstrip directional couplers and methods of their design are disclosed. According to one aspect, a microstrip directional coupler has a substrate of a first thickness. Disposed upon the substrate is a first microstrip having a first portion of a first length and a second microstrip having a second portion of a second length. The first and second microstrips are positioned to exhibit a gap between the first portion and the second portion. The first and second lengths are less than one sixteenth of a wavelength at the lowest frequency of operation of the directional coupler. The gap is less than a predetermined amount to reduce a difference in phase velocity of even and odd modes of the microstrip directional coupler.

22 Claims, 6 Drawing Sheets

(56) References Cited

OTHER PUBLICATIONS

Charles Buntschuh—"Octave-Bandwidth, High-Directivity Microstrip Couplers" Microwave Associates, Incorporated, AD-777 320 prepared for Rome Air Development Center, Griffis Air Force Base, NY dated Jan. 1974, distributed by National Technical Information Service, U.S. Department of Commerce, Springfield, VA Contract No: F30602-72-C-0282 consisting of 217-pages.

International Search Report and Written Opinion dated Sep. 15, 2014 for International Serial No. PCT/IB2014/061602, International Filing Date: May 21, 2013 consisting of 12-pages.

* cited by examiner

DIRECTIONAL COUPLER

TECHNICAL FIELD

The present invention relates to radio signal transmission, and more particularly to directional coupler devices for use in a radio signal transmission circuit.

BACKGROUND

Directional couplers are used in power control loops and in power amplifier linearization loops to sample the power of a radio frequency signal from a radio transmitter output. The sampled power may typically be 20 to 30 dB less than the output power of the transmitter. This coupled RF signal will be seen at a coupled output port of the directional coupler, and if the directional coupler is ideal, with infinite directivity, no power will be detected at an isolated port of the directional coupler.

An example of a known microstrip directional coupler 5 is shown in FIG. 1. The ideal directional coupler has the property that a wave incident in port 1 couples power to port 3 but not into port 4. Similarly, power incident in port 3 couples into port 1 but not into port 2. Thus, ports 2 and 4 are isolated. For waves incident in port 2 or 4, the power is coupled into the ports 4 or 2 only, so that ports 1 and 3 are isolated.

Directional couplers are widely used in impedance bridges for microwave measurements and for power monitoring. For example, if a radar transmitter is connected to port 1, an antenna to port 2, a microwave crystal detector to port 3, and a matched load to port 4, power received in port 3 is proportional to the power flowing from the transmitter to the antenna in the forward direction only. Since the reflected wave from the antenna, if it exists, is not coupled into port 3, the detector monitors the power output of the transmitter. In a practical directional coupler, some undesired power at the isolated port exists. This undesired power may appear as noise in power measurements and can reduce dynamic range and accuracy.

Microstrip directional couplers are ideally compact in size, use printed circuit board fabrication, are integrated with other circuitry on the printed circuit board, and provide a cost-effective solution compared to a strip line or waveguide directional coupler. The conventional microstrip directional coupler of FIG. 1 has a first microstrip 10 and a second microstrip 12 separated by a gap 13. The length of the coupled area of the microstrips are typically one quarter wavelength, and the directional coupler has quite flat coupling versus frequency characteristics, but a poor directivity. Directivity is defined as the ratio of desired power at the coupled port to the undesired power at the isolated port. The electromagnetic fields of the microstrip directional coupler exist in the dielectric and in the air. Because the even mode fields in the dielectric are slower than the odd mode fields in the air, the even and odd modes do not cancel in the reverse direction, making the directivity poor. Typically, directivity for quarter wavelength microstrip couplers is 7 to 15 dB, depending on frequency and coupling. High directivity is desired to prevent coupling of energy to an isolated port of the directional coupler. Also, the directional coupler is typically very large in physical size, especially for frequencies below 1 GHz.

One way to improve directivity is to make the directional coupler shorter than the usual quarter wavelength. For example, couplers that are an eighth of a wavelength long provide about 10 dB improvement in directivity. However, the coupling varies over the frequency significantly. To compensate for frequency variations, lumped circuit elements are used. For example, inductor 14 and impedance 16 connected to ground 18 are used to compensate for frequency variation of the isolated port 3. Impedance 19 connected to ground 18 represent a termination of the output port 4, such as a power detector. U.S. Pat. No. 5,129,298 discloses a microstrip directional coupler which uses a single compensating element, such as a capacitor or inductor, connected between the primary and secondary transmission paths of the coupler. U.S. Pat. No. 5,424,694, uses an inductor and parallel resistor in series with a coupled port. These solutions do not provide directivities above 20 dB. Further, compensating elements make the directional coupler design more complex and expensive, and take up more circuit board space.

SUMMARY

Directional couplers and methods of their design are disclosed. According to one aspect, a microstrip directional coupler has a substrate of a first thickness. Disposed upon the substrate is a first microstrip having a first portion of a first length and a second microstrip having a second portion of a second length. The first and second microstrips are positioned to exhibit a gap between the first portion and the second portion. The first and second lengths are less than one sixteenth of a wavelength at the lowest frequency of operation of the directional coupler. The gap is less than a predetermined amount to reduce a difference in phase velocity of even and odd modes of the directional coupler.

According to this aspect, in one embodiment the predetermined amount of the gap is about twice the thickness of the substrate. In one embodiment, the first length and the second length are substantially equal. In one embodiment, the first and second lengths and the first gap are chosen to achieve a coupling of electromagnetic energy between the first and second microstrips that is greater than substantially 25 dB at a lowest frequency of operation of the directional coupler. In one embodiment, the substrate is arranged to accommodate a power amplifier integrated with the directional coupler. In this embodiment, the substrate may further be arranged to accommodate an antenna feed integrated with the directional coupler. In some embodiments, the substrate is a dielectric. In one embodiment, the microstrip directional coupler includes a ground plane disposed on a side of the substrate opposite a side of the substrate having the first and the second microstrip disposed thereon.

According to another aspect, the invention provides a radio frequency, RF, output circuit. The RF output circuit includes a power amplifier, an antenna feed, and a directional coupler. The directional coupler is electrically disposed between the power amplifier and the antenna feed. The directional coupler has a first port connected to the power amplifier, a second port connected to the antenna, a third port and a fourth port. The directional coupler further includes a first microstrip having a first portion of a first length and a second microstrip having a second portion of a second length. The first microstrip and the second microstrip are positioned in parallel, having a gap between the first microstrip and the second microstrip. The first and second length are less than 1 sixteenth of a wavelength at the lowest frequency of operation. The gap is less than a predetermined amount so that the directional coupler exhibits a coupling of the first and second microstrips that exceeds substantially 20 dB, and a directivity that exceeds substantially 20 dB, at a lowest frequency of operation of the directional coupler.

According to this aspect, in one embodiment, the third port is electrically coupled to a power feedback circuit. In this embodiment, the fourth port may be electrically coupled to a reflected power detector. In one embodiment, the coupling and the directivity are achieved without additional circuit elements. In one embodiment, a variance of the coupling is less than substantially 0.5 dB over a 10% relative bandwidth for frequencies between 500 and 2,500 MHz. In one embodiment, the predetermined amount of the gap is chosen to reduce a difference in phase velocity between even and odd order modes of the directional coupler that is less than a specified velocity.

According to yet another aspect, the invention provides a method of designing a microstrip directional coupler. The method includes choosing a substrate having a thickness and a dielectric constant. The substrate is etched to form parallel microstrips having a first length disposed upon the substrate, with a gap between the parallel microstrips. The first length is chosen to be less than substantially one sixteenth of a wavelength at a frequency of operation of the directional coupler. The gap is chosen to be substantially twice the thickness of the substrate. In one embodiment, a width of the microstrips is chosen to be more than twice as wide as the gap. In another embodiment, the width of the microstrips is chosen to be more than 5 times as wide as the gap. In one embodiment, the width of the microstrips is greater than one tenth of the first length. In another embodiment, the width of the microstrips is greater than one fifth of the first length.

DETAILED DESCRIPTION

Figure 1:
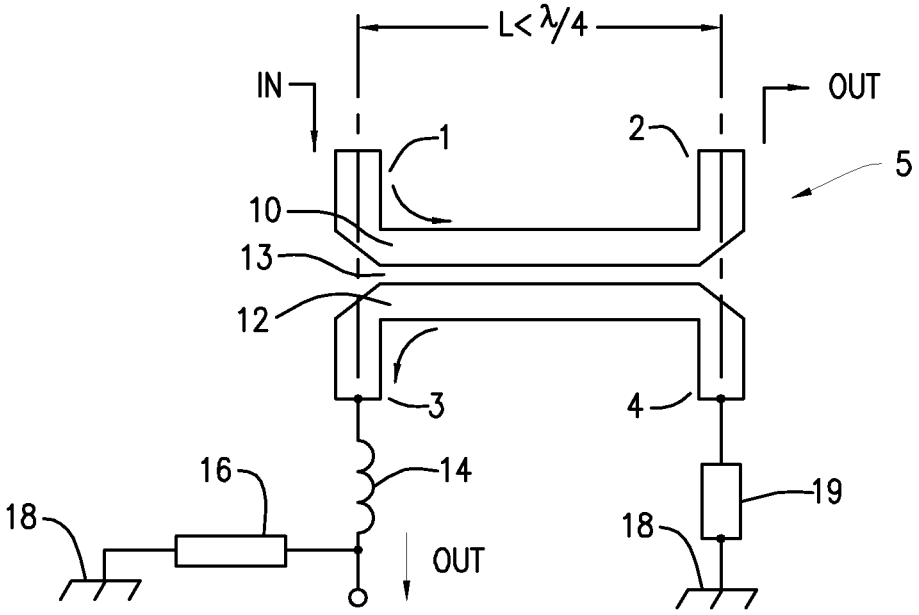
FIG. 1 (Prior Art)
FIG. 1 is a diagram of a conventional microstrip directional coupler with compensating elements.

Before describing in detail exemplary embodiments that are in accordance with the present invention, it is noted that the embodiments reside primarily in combinations of apparatus components and processing steps related to microstrip directional couplers and their design. Accordingly, the system and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

As used herein, relational terms, such as "first" and "second," "top" and "bottom," and the like, may be used solely to distinguish one entity or element from another entity or element without necessarily requiring or implying any physical or logical relationship or order between such entities or elements.

Figure 2:
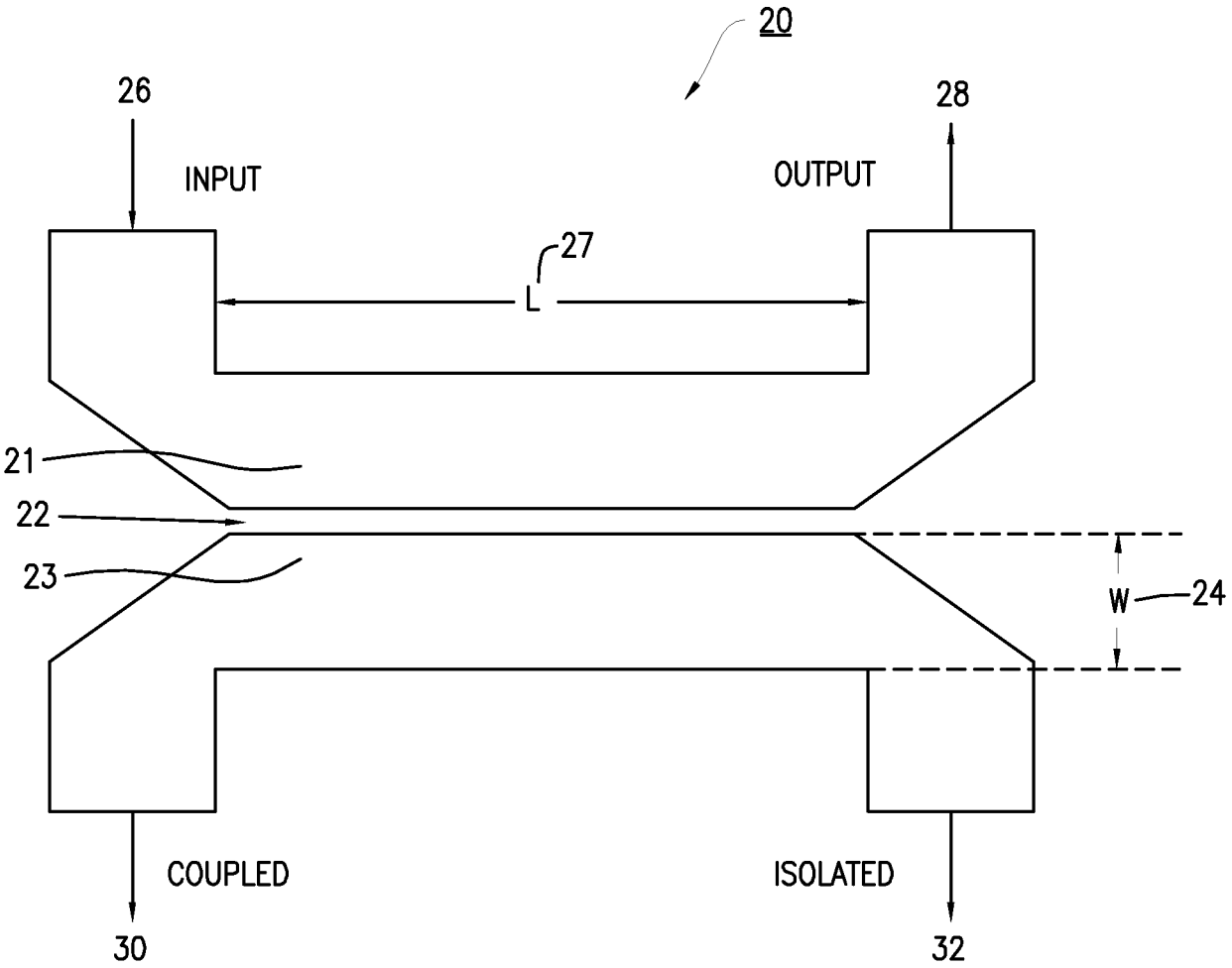
FIG. 2 is a diagram of a known microstrip directional coupler built in accordance with principles of the present invention.

Referring now to the drawing figures, where like reference designators refer to like elements, there is shown in FIG. 2 a diagram of an exemplary microstrip directional coupler 20 constructed in accordance with principles of the present invention. The microstrip directional coupler 20 has a first microstrip 21 and a second microstrip 23. The first and second microstrips 21 and 23 are separated by a gap 22. Each microstrip has a width 24. Microstrip directional coupler 20 has an input port 26, an output port 28, a coupled port 30, and isolated port 32. The microstrips 21 and 23 have a length 27 that is a sixteenth of a wavelength of the lowest operational frequency of the coupler or shorter. The microstrip directional coupler 20 advantageously provides high directivity exceeding 25 dB over wide frequency bands. Compared to conventional quarter wavelength microstrip directional coupler designs, the embodiment of FIG. 2 is smaller and easier to manufacture and integrate with other circuitry, such as a power amplifier. The embodiment of FIG. 2 provides high directivity without compensating elements which reduces cost of manufacture. Further, the embodiment achieves frequency flatness of plus or minus 0.4 dB over a 10% frequency relative bandwidth for frequencies between 50 and 2,500 MHz.

Figure 3:
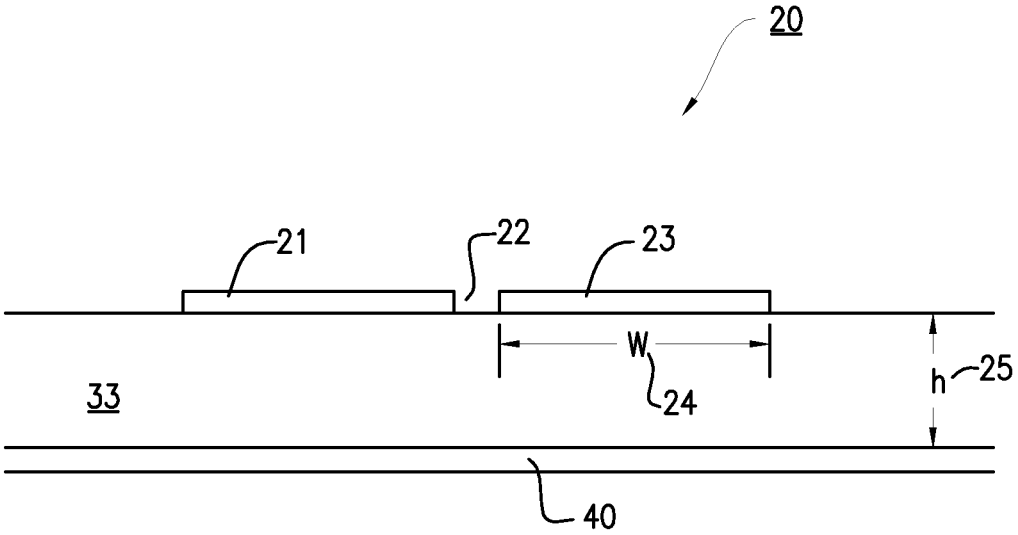
FIG. 3 is a side view of a microstrip directional coupler built in accordance with principles of the present invention.

FIG. 3 is a side view of the microstrip directional coupler 20 shown in FIG. 2. FIG. 3 shows the microstrips 21 and 23 positioned on a substrate 33. The substrate has a thickness 25. Mounted on the opposite side of the substrate is a ground plane 40. In some embodiments, the gap 22 between the microstrips is twice the thickness 25 of the substrate. In some embodiments, the gap may be chosen to reduce a difference in phase velocity between even and odd order modes of the directional coupler that is less than a specified velocity, by making the gap smaller. When the gap is made smaller, less electromagnetic energy is radiated into the air compared to energy in the dielectric in the gap area. In some embodiments, the substrate is a dielectric. In some embodiments, the width 24 of the microstrips may be greater than one tenth of the length 27 of the microstrips. In other embodiments, the width 24 of the microstrips may be greater than one fifth of the length 27 of the microstrips. In another embodiment, the width 24 of the microstrips maybe more than twice as wide as the gap 22 between the microstrips. In some embodiments, the width 24 of the microstrips may be more than 5 times as wide as the gap 22 between the microstrips. In some embodiments, the microstrip lengths, widths and the gap are chosen to achieve a directivity that is greater than substantially 20 dB at the lowest frequency of operation of the directional coupler. The specific values for the lengths, widths and the gap may be chosen based on design need, for example by simulation of a model of the coupler by electromagnetic analysis software provided that the simulation adheres to the dimensional specifications described herein. In some embodiments, the microstrip lengths, widths and the gap are chosen to achieve a coupling of electromagnetic energy between the first and second microstrips that is greater than substantially 25 dB at a lowest frequency of operation of the directional coupler.

Figure 4:
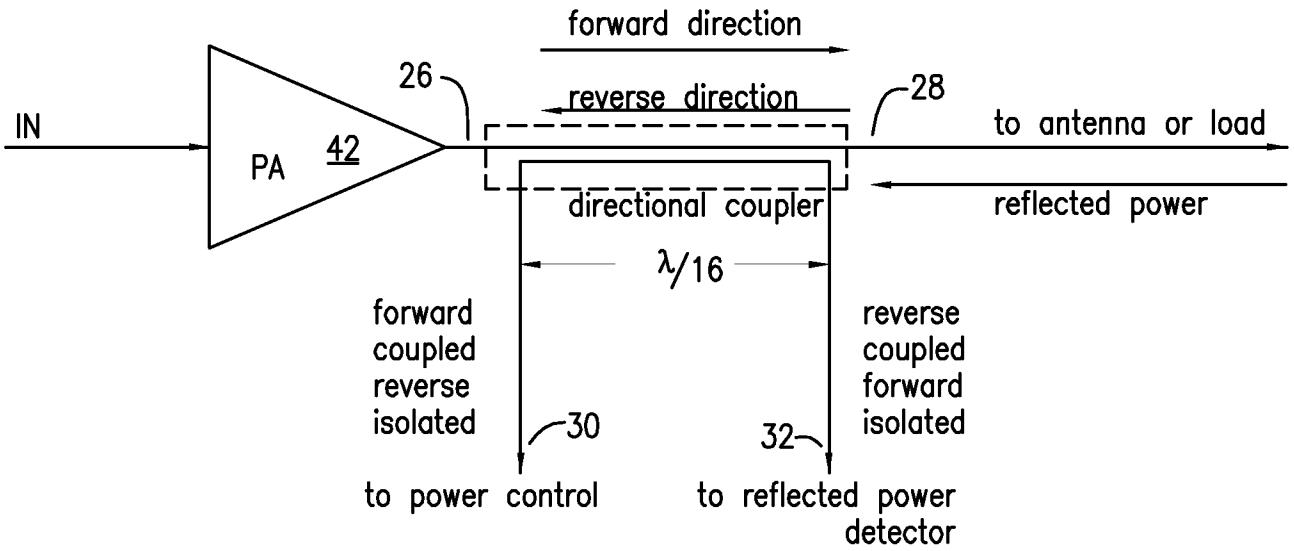
FIG. 4 is a circuit diagram of a microstrip directional coupler connected to a power amplifier and an antenna.

FIG. 4 is a circuit diagram of a microstrip directional coupler 20 electrically connected to the output of a power amplifier 42 at port 26 and is electrically connected to an antenna at port 28. Port 30 of the microstrip directional coupler is electrically connected to a power control device which measures the power received by the antenna. Port 32 of the microstrip directional coupler is connected to a reflected power detector. Thus, as explained above with reference to FIG. 1, when energy is being transmitted, a portion of the energy is coupled to the antenna at port 28, and a portion of the energy is coupled to port 30 to provide feedback to the power amplifier 42. Reflected power received from the output port 28 is coupled to port 32, to sample the amount of power that is reflected by the antenna.

Figure 5:
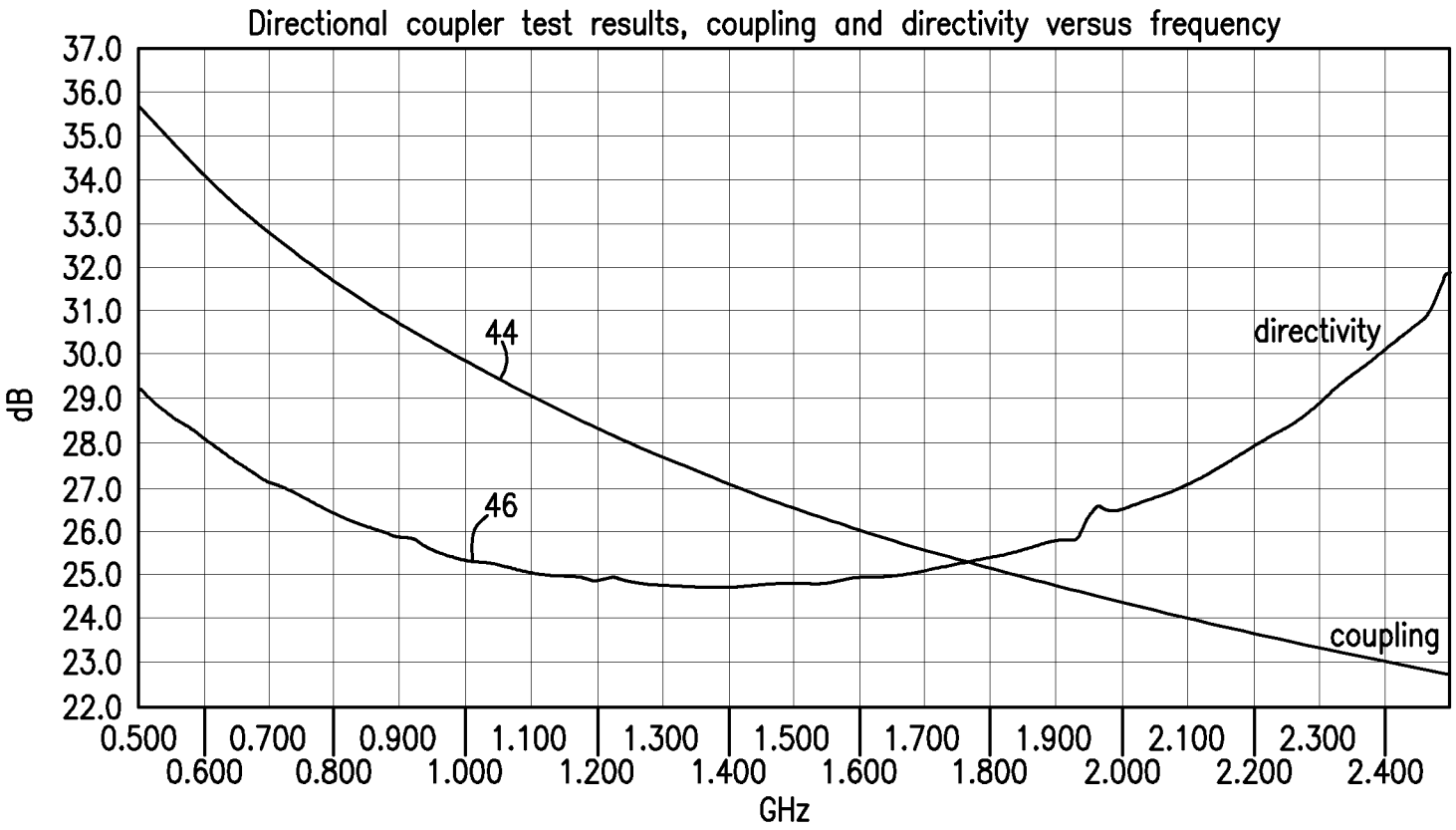
FIG. 5 is a graph of experimental results of measurements of coupling and directivity versus frequency for a microstrip directional coupler designed in accordance with principles of the present invention.

FIG. 5 is a graph of experimental data for directivity and coupling as a function of frequency for the exemplary microstrip directional coupler 20. The coupling curve 44 exceeds 22 dB over a frequency range of 0.5 GHz to 2.5 GHz. This is desirable to achieve maximum transport of energy between an input port and a forward coupled output port over a wide frequency band. The directivity curve 46 exceeds 25 dB over the same frequency range. This is desirable to prevent substantial energy being transported to a reverse port over a wide frequency band. Note that the coupling and the directivity are achieved without additional circuit elements, such as inductors or capacitors. A variance of the coupling may be achieved that is less than substantially 0.5 dB over a 10% relative bandwidth for frequencies between 500 and 2,500 MHz.

Figure 6:
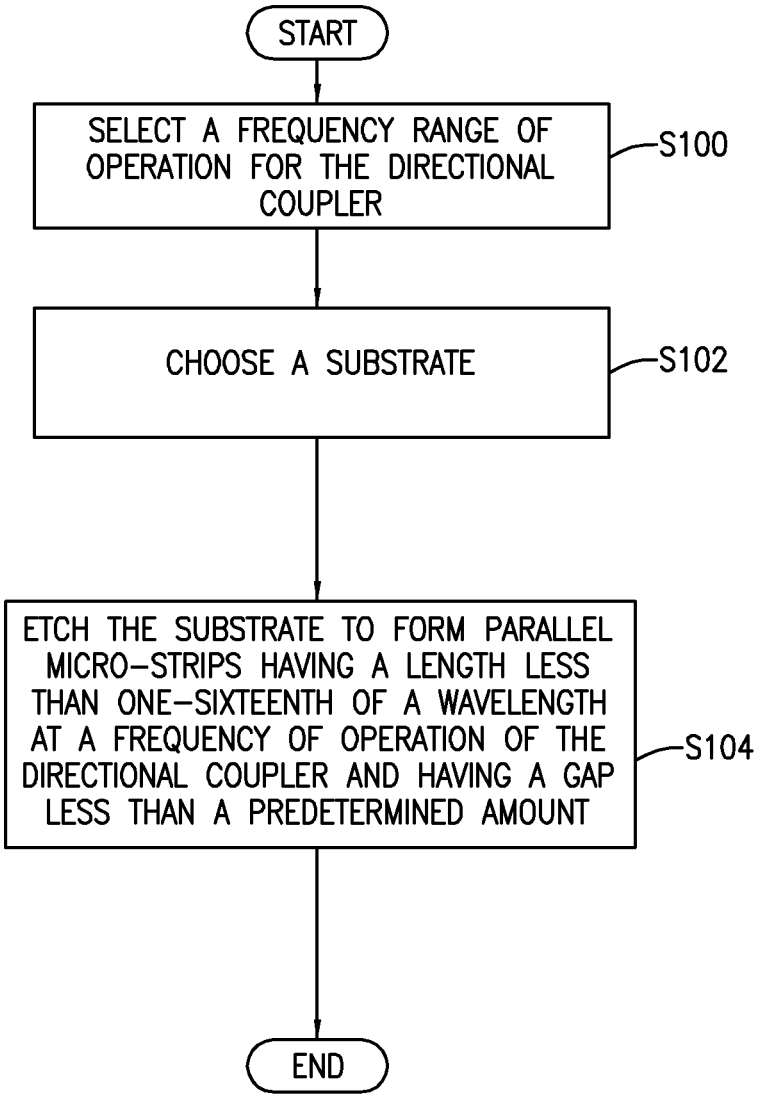
FIG. 6 is a flowchart of an exemplary process for designing a microstrip directional coupler in accordance with principles of the present invention.

FIG. 6 is a flowchart of an exemplary process for designing a microstrip directional coupler such as the directional coupler 20. A frequency range of operation for the directional coupler 20 is selected (block S100) based on a frequency range of operation of a device connected to the directional coupler. A substrate 33 of a desired thickness 25 is chosen (block S102) such as by software simulation. The substrate 33 is etched using well known circuit board manufacture techniques to form parallel metallic microstrips 21, 23 having a length less than 1/16 of a wavelength at a frequency of operation of the directional coupler and having a gap 22 between the microstrips that is less than a predetermined amount (block S104). According to these methods, a directional coupler is obtained that has high directivity over a broad frequency band.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

What is claimed is:

1. A micro-strip directional coupler, the micro-strip directional coupler comprising:

a substrate having a first thickness; and disposed upon the substrate:

a first micro-strip in air having a first portion of a first length; and a second micro-strip in air having a second portion of a second length directed parallel to the first portion, the first and second micro-strips being positioned to exhibit a first gap between the first portion and the second portion, the first and second lengths being less than one-sixteenth of a wavelength in air at a lowest frequency of operation of the directional coupler, the first gap being less than a predetermined amount to reduce a difference in phase velocity of even and odd order modes of the directional coupler.

2. The directional coupler of claim 1, wherein the predetermined amount is substantially twice a thickness of the substrate.

3. The directional coupler of claim 1, wherein the first length and the second length are substantially equal.

4. The directional coupler of claim 1, wherein the first and second lengths and the first gap are chosen to achieve a coupling of electromagnetic energy between the first and second micro-strips that is greater than substantially 25 decibels, dB, at a lowest frequency of operation of the directional coupler.

5. The directional coupler of claim 4, wherein the first and second lengths and the first gap are chosen to achieve a directivity that is greater than substantially 20 dB at the lowest frequency of operation of the directional coupler.

6. The directional coupler of claim 1, wherein the first and second lengths and the first gap are chosen to achieve a directivity that is greater than substantially 20 dB at the lowest frequency of operation of the directional coupler.

7. The directional coupler of claim 1, wherein the substrate is arranged to accommodate a power amplifier integrated with the directional coupler.

8. The directional coupler of claim 7, wherein the substrate is further arranged to accommodate an antenna feed integrated with the directional coupler.

9. The directional coupler of claim 1, wherein the substrate is a dielectric.

10. The directional coupler of claim 1, further comprising a ground plane disposed on a side of the substrate opposite a side of the substrate having the first and the second microstrip disposed thereon.

11. A radio frequency, RF, output circuit comprising:

a power amplifier;

an antenna feed; and a directional coupler electrically disposed between the power amplifier and the antenna, the directional coupler having a first port connected to the power amplifier, a second port connected to the antenna, a third port, and a fourth port, the directional coupler further including:

a first micro-strip in air having a first portion of a first length; and a second micro-strip in air having a second portion of a second length, the first micro-strip and the second micro-strip positioned in parallel with a gap between the first micro-strip and the second micro-strip, the first and second lengths being less than one-sixteenth of a wavelength in air at a lowest frequency of operation of the directional coupler and the gap being less than a predetermined amount so that the directional coupler exhibits a coupling of the first and second micro-strips that exceeds substantially 20 decibels, dB, and a directivity that exceeds substantially 20 dB, at the lowest frequency of operation of the directional coupler.

12. The RF output circuit of claim 11, wherein the third port is electrically coupled to a power feedback circuit.

13. The RF output circuit of claim 12, wherein the fourth port is electrically coupled to a reflected power detector.

14. The RF output circuit of claim 11, wherein the fourth port is electrically coupled to a reflected power detector.

15. The RF output circuit of claim 11, wherein the coupling and the directivity are achieved without additional circuit elements.

16. The RF output circuit of claim 11, wherein a variance of the coupling is less than substantially 0.5 dB over a 10 percent relative bandwidth for frequencies between 500 and 2500 Megahertz, MHz.

17. The RF output circuit of claim 11, wherein the predetermined amount is chosen to reduce a difference in phase velocity between even and odd order modes of the directional coupler that is less than a specified velocity.

18. A method of designing a directional coupler, the method comprising:

choosing a substrate having a thickness and a dielectric constant; and etching the substrate to form parallel micro-strips in air having a first length, with a gap between the parallel micro-strips, the first length chosen to be less than substantially one-sixteenth of a wavelength in air at a lowest frequency of operation of the directional coupler, the gap being less than a predetermined amount to reduce a difference in phase velocity of even and odd order modes of the directional coupler.

19. The method of claim 18, further comprising choosing a width of the micro-strips to be more than twice as wide as the gap.

20. The method of claim 18, further comprising choosing a width of the micro-strips to be more than five times as wide as the gap.

21. The method of claim 18, wherein a width of the micro-strips is greater than one tenth of the first length.

22. The method of claim 18, wherein a width of the micro-strips is greater than one fifth of the first length.

* * * * *